US010316850B2

(12) United States Patent
Yamamoto et al.

(10) Patent No.: US 10,316,850 B2
(45) Date of Patent: Jun. 11, 2019

(54) CEILING FAN

(71) Applicants: Panasonic Manufacturing Malaysia Berhad, Shah Alam, Selangor Darul Ehsan (MY); Panasonic Corporation, Osaka (JP)

(72) Inventors: Kiminobu Yamamoto, Kuala Lumpur (MY); Kee Cheng Ng, Klang (MY); Boon Hooi Teo, Klang (MY); Hiroyuki Kuramochi, Aichi (JP)

(73) Assignees: PANASONIC MANUFACTURING MALAYSIA BERHAD (MY); PANASONIC CORPORATION, Osaka (JP)

( * ) Notice: Subject to any disclaimer, the term of this patent is extended or adjusted under 35 U.S.C. 154(b) by 275 days.

(21) Appl. No.: 15/514,898

(22) PCT Filed: Aug. 31, 2015

(86) PCT No.: PCT/JP2015/004424

§ 371 (c)(1),
(2) Date: Mar. 28, 2017

(87) PCT Pub. No.: WO2016/051665

PCT Pub. Date: Apr. 7, 2016

(65) Prior Publication Data

US 2017/0218962 A1 Aug. 3, 2017

(30) Foreign Application Priority Data

Sep. 29, 2014 (MY) ..... PI 2014702866
Mar. 30, 2015 (MY) ..... PI 2015701015

(51) Int. Cl.
*F04D 25/08* (2006.01)
*F04D 29/00* (2006.01)
(Continued)

(52) U.S. Cl.
CPC ..... *F04D 25/088* (2013.01); *F04D 29/00* (2013.01); *F04D 29/325* (2013.01); *F04D 29/34* (2013.01); *F04D 29/322* (2013.01); *F04D 29/329* (2013.01)

(58) Field of Classification Search
CPC ..... F04D 25/088; F04D 29/34; F04D 29/00; F04D 29/325; F04D 29/322; F04D 29/329; F16B 2/248; F16B 5/125
(Continued)

(56) References Cited

U.S. PATENT DOCUMENTS 1,888,795 A * 11/1932 Faber ..... F01D 5/24 416/196 R
3,520,637 A * 7/1970 Harry ..... F16C 7/026 416/114
(Continued)

FOREIGN PATENT DOCUMENTS

JP 11-132192 A 5/1999
JP 2009-041392 A 2/2009
(Continued)

OTHER PUBLICATIONS

International Search Report of PCT application No. PCT/JP2015/004424 dated Dec. 1, 2015.
(Continued)

*Primary Examiner* — Sizo B Vilakazi
*Assistant Examiner* — Brian R Kirby
(74) *Attorney, Agent, or Firm* — Pearne & Gordon LLP

(57) ABSTRACT

In a ceiling fan in which root portions of blades are attached to a support portion to be rotary driven, a fall preventing member having a loop portion formed by a wire rod is provided, a through hole of which the loop portion of the fall preventing member penetrates is provided on the root portions of the blades, the support portion is provided with an
(Continued)

engaging portion which is engageable with the loop portion of the fall preventing member, the loop portion of the fall preventing member is disposed to be engageable with the engaging portion of the support portion, the loop portion is engaged with the engaging portion of the support portion when an attachment part of the support portion and the blades is broken, and the blades are supported on the support portion through the loop portion of the fall preventing member in a state in which inner edges of the root portions of the blades are positioned on an outside of an outer edge of the support portion.

9 Claims, 12 Drawing Sheets

(51) Int. Cl.
*F04D 29/32* (2006.01)
*F04D 29/34* (2006.01)

(58) Field of Classification Search
USPC ..... 416/2, 5, 210 R, 220 A, 221, 248
See application file for complete search history.

(56) References Cited

U.S. PATENT DOCUMENTS 4,175,622 A * 11/1979 Summerfelt ..... A01G 3/062 172/14
5,542,819 A 8/1996 Bucher et al.
6,155,787 A * 12/2000 Hodgkins, Jr. ..... F04D 25/088 416/210 R
6,619,919 B2 9/2003 Kerr, Jr.
6,881,037 B2 * 4/2005 Marshall ..... F04D 25/088 403/291
8,070,447 B2 12/2011 Itou et al.
8,328,521 B2 12/2012 Itou et al.
8,672,649 B2 * 3/2014 Smith ..... F04D 25/088 417/423.1
8,851,841 B2 * 10/2014 Care ..... F04D 29/366 416/5
2009/0081045 A1 * 3/2009 Scherer ..... F04D 29/329 416/214 R
2010/0124504 A1 * 5/2010 Yao ..... F04D 25/088 416/210 R
2010/0129225 A1 * 5/2010 Itou ..... F04D 25/0606 416/204 R
2012/0039717 A1 2/2012 Itou et al.
2013/0280077 A1 * 10/2013 Iwamoto ..... F04D 25/088 416/204 R
2015/0086375 A1 * 3/2015 Kuramochi ..... F04D 29/34 416/220 R

FOREIGN PATENT DOCUMENTS

JP 2009041392 A * 2/2009
JP 2009121243 A * 6/2009
WO 2013/145656 A1 10/2013

OTHER PUBLICATIONS

International Preliminary Report on Patentability issued in Patent Application No. PCT/JP2015/004424 dated Apr. 13, 2017.

* cited by examiner

CEILING FAN

TECHNICAL FIELD

The present invention relates to a ceiling fan.

BACKGROUND ART

Conventionally, there are known various types of ceiling fans suspended from a ceiling for use. For example, the conventional ceiling fan includes a coupling portion having an upper part supported on a ceiling, a rotary driving portion attached to a lower part of the coupling portion, a plurality of blades to be rotated by the rotary driving portion, and a support portion to which root portions of the blades are attached in a mounting state. The rotary driving portion has a stator fixed to the coupling portion and a rotor to be rotary driven around the stator. The support portion is fixed to the rotor. When the rotor is rotary driven, the respective blades attached to the support portion are rotated together with the support portion.

The conventional ceiling fan having the structure is devised in respect of safety, for example, a blade fall preventing portion is provided so as not to separate the blades from the support portion even if the blade is broken in the root portion (see Patent Document 1, for example).

A structure of the blade fall preventing portion provided in the conventional ceiling fan will be described with reference to FIG. 15 showing an attachment state to a support portion 112 in a root portion 111 of a blade 110. As shown in FIG. 15, the root portion 111 of the blade 110 has a screw fastening holes 113 (two places) provided in the vicinity of both ends in a width direction and an engaging hole 114 (one place) provided on a center in the width direction. Moreover, an engaging portion 115 protruded from an upper surface is provided on the support portion 112.

As shown in FIG. 15, the root portion 111 of the blade 110 is fastened with a screw by using the fastening holes 113 in the two places in a mounting state on the upper surface of the support portion 112. Consequently, the blade 110 is brought into an attachment state to the support portion 112. In the attachment state, furthermore, the engaging portion 115 of the support portion 112 penetrates the engaging hole 114 of the root portion 111 on the blade 110.

In the case in which a vicinal part of the fastening hole 113 is broken in the root portion 111 of the blade 110, for example, the engaging portion 115 is engaged with the engaging hole 114 so that the blade 110 can be prevented from falling. Referring to the conventional ceiling fan in FIG. 15, thus, the blade fall preventing portion is configured from the engaging portion 115 and the engaging hole 114.

CONVENTIONAL ART DOCUMENT

Patent Document

Patent Document 1: WO2013/145656

SUMMARY OF THE INVENTION

Problems to be Solved by the Invention

In the case in which the root portion of the blade is broken, however, a part of the root portion is placed on the support portion. For this reason, there is a problem in that an amount of suspension of the blade (an amount of downward inclination) is small and hard for a user to notice breakage of the blade at a stop time as well as at an operation time.

In order to solve the conventional problem, it is an object of the present invention to provide a ceiling fan capable of causing a user to clearly recognize breakage at an operation time and a stop time if a blade is broken.

Means for Solving the Problems

In order to solve the conventional problem, a ceiling fan according to an aspect of the present invention includes a coupling portion having an upper part supported on a ceiling; a rotary driving portion having a stator fixed to a lower part of the coupling portion and a rotor to be rotary driven around the stator; a plurality of blades to be rotated around a center of the rotor by the rotary driving portion; a support portion which is fixed to the rotor and to which root portions of the blades are attached in a mounting state; and a fall preventing member having a loop portion formed by a wire rod so as to be engageable with the blades and the support portion, and, in the ceiling fan, a through hole that the loop portion of the fall preventing member penetrates is provided in the root portions of the blades, the support portion is provided with an engaging portion which is engageable with the loop portion of the fall preventing member, and the loop portion of the fall preventing member is disposed to be engageable with the engaging portion of the support portion in a state that the blades are attached to the support portion, the loop portion is engaged with the engaging portion of the support portion when an attachment part of the support portion and the blades is broken, and the blades are held on the support portion through the loop portion of the fall preventing member in a state that inner edges of the root portions of the blades are positioned on an outside of an outer edge of the support portion.

Effects of the Invention

According to the present invention, it is possible to provide a ceiling fan capable of causing a user to clearly recognize breakage at an operation time and a stop time if a blade is broken.

MODES FOR CARRYING OUT THE INVENTION

Figure 1:
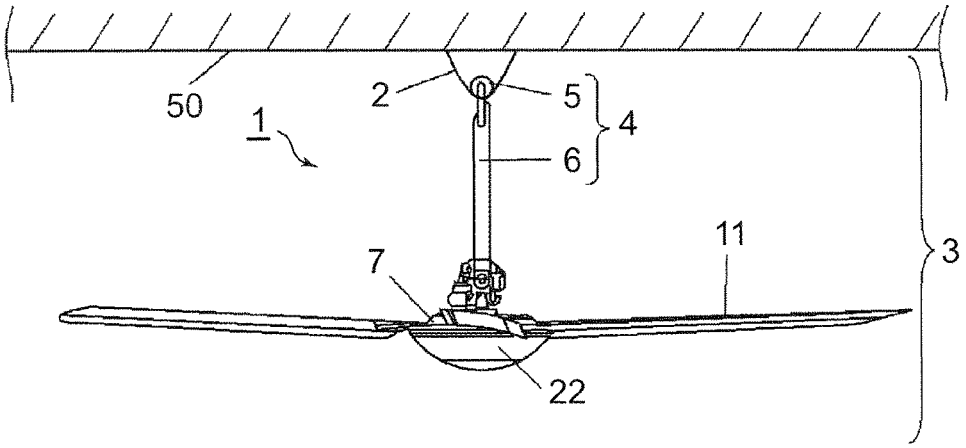
FIG. 1 is a side view showing a ceiling fan according to a first embodiment of the present invention.

A ceiling fan according to a first invention includes a coupling portion having an upper part supported on a ceiling; a rotary driving portion having a stator fixed to a lower part of the coupling portion and a rotor to be rotary driven around the stator; a plurality of blades to be rotated around a center of the rotor by the rotary driving portion; a support portion which is fixed to the rotor and to which root portions of the blades are attached in a mounting state; and a fall preventing member having a loop portion formed by a wire rod so as to be engageable with the blades and the support portion, and, in the ceiling fan, a through hole that the loop portion of the fall preventing member penetrates is provided in the root portions of the blades, the support portion is provided with an engaging portion which is engageable with the loop portion of the fall preventing member, and the loop portion of the fall preventing member is disposed to be engageable with the engaging portion of the support portion in a state that the blades are attached to the support portion, the loop portion is engaged with the engaging portion of the support portion when an attachment part of the support portion and the blades is broken, and the blades are held on the support portion through the loop portion of the fall preventing member in a state that inner edges of the root portions of the blades are positioned on an outside of an outer edge of the support portion.

According to a second invention, in the ceiling fan according to the first invention, a protruded portion is formed as the engaging portion on the support portion, and the root portion of the blade is provided with an opening groove which is extended in a length direction of the blade and is opened at the inner edge of the root portion, and is slidably engaged with the protruded portion, and in a state that the blade is attached to the support portion, the protruded portion of the support portion is engaged with the opening groove of the root portion of the blade, and the loop portion of the fall preventing member is disposed around the protruded portion.

According to a third invention, in the ceiling fan according to the first or second invention, the blade is attached to the support portion by a fastening member through a fastening hole provided on the root portion of the blade, and the fastening hole is provided separately from a through hole that the loop portion of the fall preventing member penetrates.

According to a fourth invention, in the ceiling fan according to any of the first to third inventions, the through hole of the root portion of the blade is disposed in a shifted position from a center in a width direction of the blade.

According to a fifth invention, in the ceiling fan according to any of the first to fourth inventions, the through hole of the root portion of the blade is a slot extended in a length direction of the blade, and the loop portion of the fall preventing member penetrates an opening portion at an outside in the length direction of the blade in the slot in a state that the blade is attached to the support portion.

According to a sixth invention, in the ceiling fan according to any of the first to fifth inventions, the loop portion of the fall preventing member includes a discontinuous part of a wire rod and the fall preventing member has a clip function for fixing the loop portion to the blade releasably with front and back faces of the blade interposed by elastic deformation of the loop portion in a thickness direction of the blade.

According to a seventh invention, in the ceiling fan according to the sixth invention, the inner edge of the root portion of the blade is provided with a notch portion where one of ends of the wire rod of the fall preventing member is inserted and engaged.

According to an eighth invention, in the ceiling fan according to the seventh invention, the blade is provided with a plurality of groove extending in the length direction of the blade on a back face of the blade, and the one of ends of the wire rod of the fall preventing member which is inserted in the notch portion of the inner edge of the root portion of the blade is disposed in the groove of the blade and engaged with the groove of the blade.

According to a ninth invention, in the ceiling fan according to any of the first to eighth inventions, the fall preventing member includes a first loop portion penetrating the through hole of the root portion of the blade and a second loop portion which is engageable with the engaging portion of the support portion, and the first loop portion and the second loop portion are formed continuously by a single wire rod.

Embodiments according to the present invention will be described below with reference to the drawings. The present invention is not restricted to the embodiments.

First Embodiment

Figure 2:
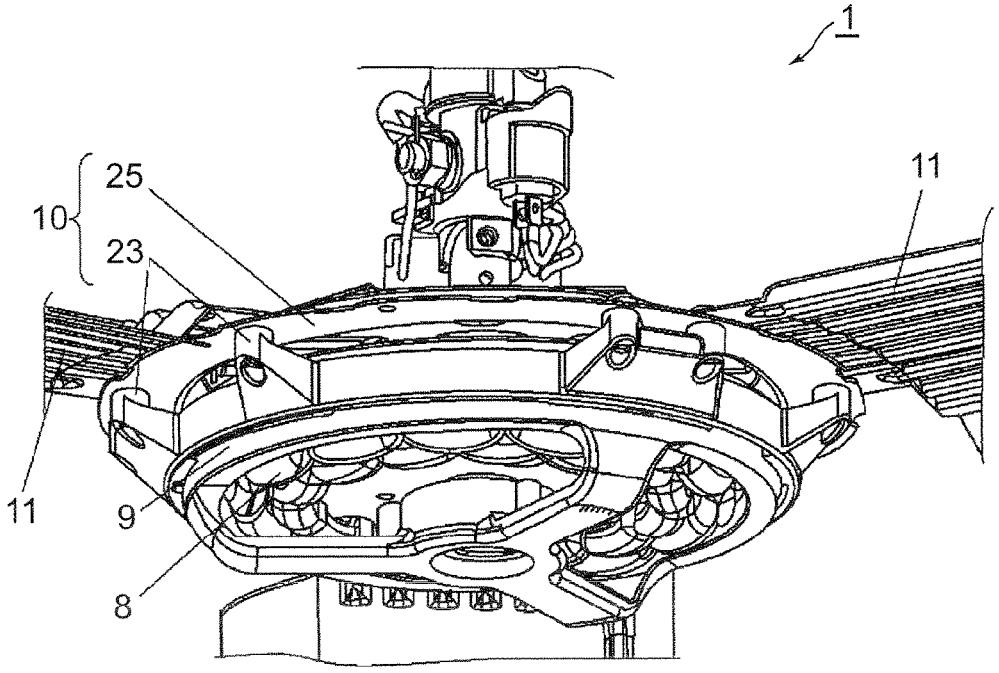
FIG. 2 is a partial enlarged view showing the ceiling fan according to the first embodiment.

FIG. 1 is a side view showing a ceiling fan 1 according to a first embodiment of the present invention and FIG. 2 is a partial enlarged view showing the ceiling fan 1.

As shown in FIGS. 1 and 2, the ceiling fan 1 includes a suspending portion 2 fixed to a ceiling 50 and a body portion 3 supported in engagement with the suspending portion 2. The body portion 3 includes a coupling portion 4, a rotary driving portion 7, a support portion 10, a plurality of blades 11, and a body cover 22.

The coupling portion 4 includes a joint 5 to be engaged with the suspending portion 2 and a pipe 6 fixed to a lower part of the joint 5. The joint 5 is suspended in engagement with the suspending portion 2 fixed to the ceiling 50.

Consequently, the coupling portion 4 is supported on the ceiling 50 through the suspending portion 2. It is possible to employ a structure in which the ceiling fan 1 does not include the suspending portion 2 and the coupling portion 4 is supported by direct suspension from the ceiling 50.

The rotary driving portion 7 is supported on the coupling portion 4. The rotary driving portion 7 includes a stator 8 taking a shape of an almost circular plate which is fixed to a lower part of the pipe 6 and an almost annular rotor 9 to be rotated around the stator 8. The rotary driving portion 7 is conducted so that the rotor 9 is rotated around the stator 8. The support portion 10 is fixed to a peripheral edge of the rotor 9 and is rotated integrally with the rotor 9. A body cover 22 is attached to cover a lower part of the rotary driving portion 7.

The blades 11 are removably attached to the support portion 10. As shown in FIG. 2, the support portion 10 includes a receiving portion 25 to be a flat plate member taking an annular shape, and a fixing portion 23 for supporting the receiving portion 25 from a lower side. A root portion of the blade 11 is placed on the receiving portion 25, and the respective blades 11 are removably fixed to the receiving portion 25 and the fixing portion 23 with a screw to be a fastening member as will be described below.

Figure 3:
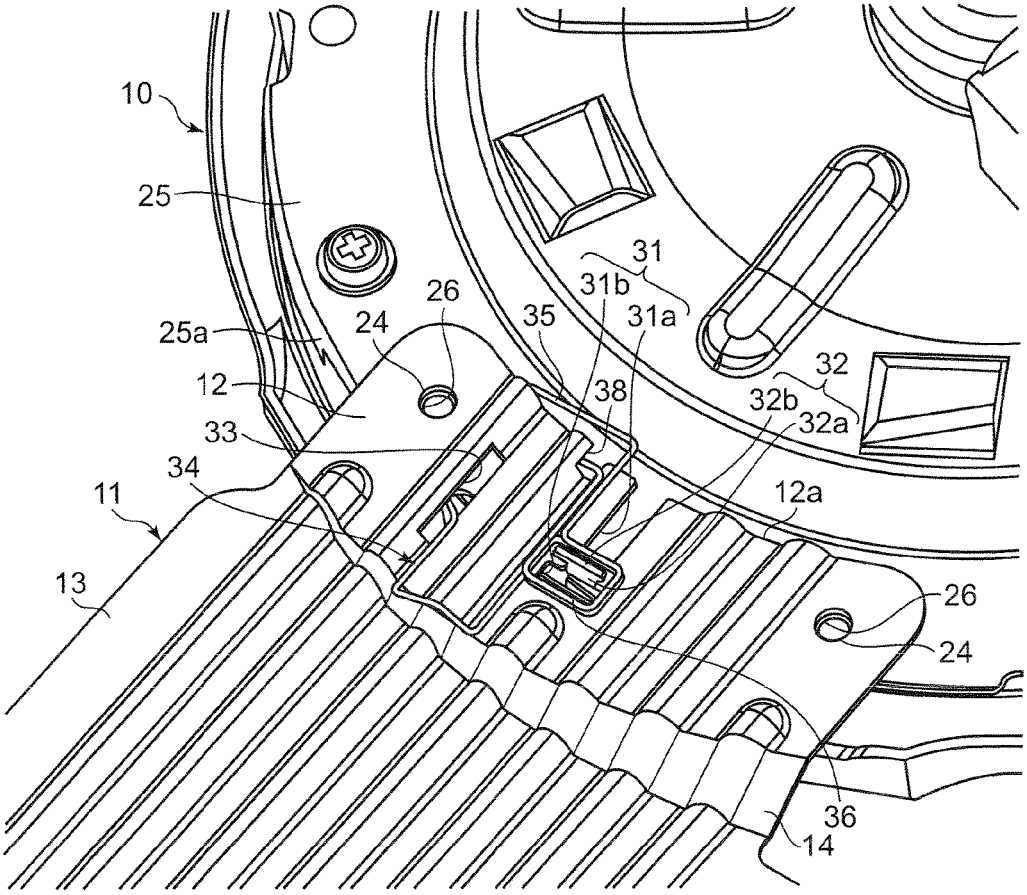
FIG. 3 is a partial enlarged view showing an attachment part of a blade to a support portion which are provided in the ceiling fan according to the first embodiment.

FIG. 3 is a partial enlarged view showing an attachment part of the blade 11 to the support portion 10 in the ceiling fan 1. As shown in FIG. 3, the blade 11 includes a root portion 12 mounted (placed) on the receiving portion 25 of the support portion 10, a vane portion 13 to be a part positioned on an outside in a radial direction from the root portion 12 and serving to substantially send air, and a step portion 14 positioned between the root portion 12 and the vane portion 13. The blade portion 11 is formed as a metal plate integrally with the root portion 12, the vane portion 13, and the step portion 14, for example. A step height in a width direction of the blade 11 is set to the step portion 14 in such a manner that the vane portion 13 is disposed with inclination at a suitable angle for blast with respect to the root portion 12 provided in an almost horizontal state. Specifically, the vane portion 13 is disposed with inclination with respect to a rotating direction in such a manner that an edge on a rear side in the rotating direction of the blade 11 is lower than an edge on a forward side in the width direction. In order to increase rigidity, moreover, a plurality of ridges and grooves (convex portions and concave portions) extended in a longitudinal direction is provided on the blade 11.

As shown in FIG. 3, two fastening holes 24 are provided in the vicinity of both ends in the width direction in the root portion 12 of the blade 11. A plurality of holes 26 is provided on the receiving portion 25 of the support portion 10. A fastening member (not shown) such as a screw is inserted into the fastening holes 24 of the root portion 12 of the blade 11 and the holes 26 of the receiving portion 25 to carry out fastening to the fixing portion 23. Consequently, the root portion 12 of the blade 11 is attached to the support portion 10 in a mounting state.

Next, description will be given to a structure for preventing fall of the blade 11 in the case in which the attachment part (the root portion 12 or the like) of the blade 11 in the ceiling fan 1 is broken.

As shown in FIG. 3, an opening groove 31 is provided on a central part in the width direction in the root portion 12 of the blade 11. The opening groove 31 is extended in a length direction of the blade 11 and is opened on an inner edge 12*a* of the root portion 12. The opening groove 31 includes a first hole 31*a* to be an almost square hole which is opened on the inner edge 12*a* of the root portion 12 and a second hole 31*b* to be an almost square hole communicating with the first hole 31*a* and having a greater opening width than the first hole 31*a*. The first hole 31*a* is positioned on the inner edge 12*a* side of the root portion 12 from the second hole 31*b*.

A protruded portion 32*a* protruded upward is provided in the vicinity of an outer peripheral edge 25*a* of the receiving portion 25 of the support portion 10 (an outer edge of the support portion 10). The protruded portion 32 is a plate-shaped protruded portion taking a T shape seen from the length direction (a radial direction) of the blade 11. The protruded portion 32 includes a first flat plate portion 32*a* taking a shape of an almost square plate fixed to the receiving portion 25 and a second flat plate portion 32*b* taking a shape of an almost square plate fixed to an upper part of the first flat plate portion 32*a* and having a greater width than the first flat plate portion 32*a* in the width direction of the blade 11.

Description will be given to the relationship between the opening groove 31 provided on the root portion 12 of the blade 11 and the protruded portion 32 provided on the receiving portion 25. A width of the second flat plate portion 32*b* of the protruded portion 32 is smaller than an opening width of the second hole 31*b* of the opening groove 31 and is greater than an opening width of the first hole 31*a*. A width of the first flat plate portion 32*a* of the protruded portion 32 is smaller than the opening width of the first hole 31*a* of the opening groove 31.

Consequently, the root portion 12 of the blade 11 is mounted on the receiving portion 25 of the support portion 10 so that the protruded portion 32 is inserted into the second hole 31*b* of the opening groove 31. Then, the blade 11 is moved by a predetermined amount outward in the radial direction so that the first flat plate portion 32*a* of the protruded portion 32 is slid into the first hole 31*a* of the opening groove 31. As a result, the second flat plate portion 32*b* of the protruded portion 32 and the first hole 31*a* of the opening groove 31 are brought into an engaging state in at least width and thickness directions of the blade 11 as shown in FIG. 3. In this state, the two fastening holes 24 of the root portion 12 of the blade 11 are positioned on the two holes 26 of the receiving portion 25 so that a fastening member (not shown) such as a screw can be inserted therein.

As shown in FIG. 3, a through hole 33 is provided on the root portion 12 of the blade 11 separately from the two fastening holes 24 and the opening groove 31. The through hole 33 is formed between one of the fastening holes 24 and the opening groove 31 and is formed as a slot extended in the length direction of the blade 11, and furthermore, is disposed in a position shifted from a center in the width direction of the blade 11. The fall preventing member 34 penetrates the through hole 33, and a loop portion of the fall preventing member 34 penetrates an opening part of the slot shape at an outer side in the length direction of the blade 11.

Figure 4:
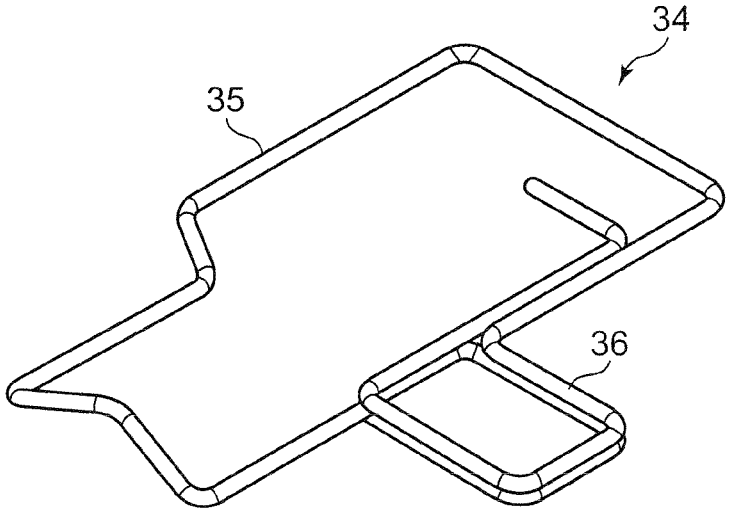
FIG. 4 is a perspective view showing a fall preventing member provided in the ceiling fan according to the first embodiment.

FIG. 4 is a perspective view showing the fall preventing member 34. As shown in FIGS. 3 and 4, the fall preventing member 34 has a loop portion formed by a wire rod and a metal wire rod having rigidity is used for the wire rod, for example. The fall preventing member 34 has a first loop portion 35 and a second loop portion 36, and the first loop portion 35 is formed as a larger loop portion than the second loop portion 36. For example, the first loop portion 35 is formed to be a single loop and the second loop portion 36 is formed to be a double loop. Each of the loop portions 35 and 36 is formed continuously by bending a single wire rod. For this reason, the first loop portion 35 and the second loop portion 36 include discontinuous parts of the wire rod (for example, parts in which wire rods are caused to be close to each other so that a loop shape is substantially obtained) respectively. By applying external force to elastically deform the wire rod, for example, it is possible to enlarge the discontinuous part, thereby opening the loop portion.

The fall preventing member 34 having the structure is attached to the root portion 12 of the blade 11 as shown in FIG. 3. Specifically, the wire rod configuring the first loop portion 35 penetrates the through hole 33 of the root portion 12 of the blade 11. The second loop portion 36 is disposed so as to surround the second hole 31*b* of the opening groove 31. Furthermore, one of ends of the wire rod in the fall preventing member 34 is inserted in and engaged with a notch portion 38 provided on the inner edge 12*a* of the root portion 12 of the blade 11. As described above, the fall preventing member 34 includes discontinuous parts of the wire rod. Each of the wire rods configuring the first and second loop portions 35 and 36 is elastically deformed in the thickness direction of the blade 11 to enlarge the discontinuous part and is thus caused to penetrate the through hole 33, and furthermore, one of ends of the wire rod is inserted in the notch portion 38. Consequently, the wire rod configuring the fall preventing member 34 can be releasably fixed to the blade 11 with front and back faces of the blade 11 interposed. In other words, the fall preventing member 34 has a clip function for interposing and fixing the front and back faces of the blade 11 while performing the elastic deformation.

In a state in which the root portion 12 of the blade 11 to which the fall preventing member 34 is fixed is mounted on the receiving portion 25 and is attached with a fastening member (not shown) such as a screw as shown in FIG. 3, moreover, the protruded portion 32 of the receiving portion 25 is engaged with the opening groove 31 of the blade 11. The second loop portion 36 of the fall preventing member 34 is disposed around the protruded portion 32 in this state.

Description will be given to an operation of the ceiling fan 1 according to the first embodiment having such a structure. In the ceiling fan 1, when the rotary driving portion 7 is conducted, the rotor 9 is rotated. The blade 11 fixed to the support portion 10 is rotated around a center of the rotor 9 together with the support portion 10 by the rotation. In the blade 11, the vane portion 13 is gradually inclined obliquely and downward from a forward side toward a rear side in a rotating direction by the step portion 14. Therefore, air flowing along a lower surface of the vane portion 13 is sent from the ceiling 50 side in a floor direction (downward). The respective blades 11 are rotary driven at a rotating speed of approximately 200 to 300 rotations/minute, for example.

Description will be given to a function and operation for preventing fall of the blade 11 by the fall preventing member 34 in the case in which the attachment part of the blade 11 to the support portion 10 is broken, for example, the root portion 12 of the blade 11 is broken in the ceiling fan 1 according to the first embodiment.

In the case in which the attachment part of the blade 11 and the support portion 10 is broken during the operation of the ceiling fan 1, the root portion 12 of the blade 11 tries to be separated by centrifugal force in an outer direction (outward in a radial direction) from the receiving portion 25 of the support portion 10. When the blade 11 starts movement outward in the radial direction, the opening groove 31 engaged with the protruded portion 32 is slid with respect to the protruded portion 32 of the receiving portion 25. Consequently, the second loop portion 36 of the fall preventing member 34 disposed around the protruded portion 32 comes in contact with the protruded portion 32 and the sliding movement further proceeds so that the second loop portion 36 is engaged with the protruded portion 32 (is brought into a catching state).

Figure 5:
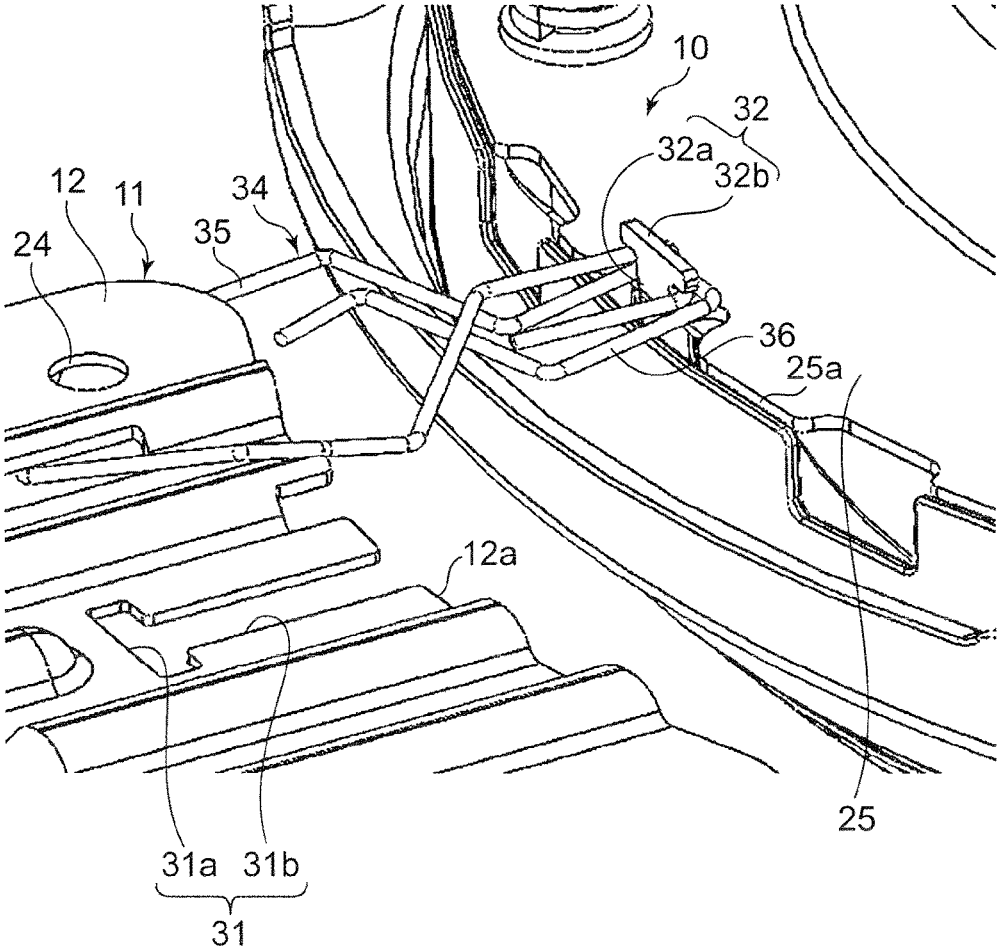
FIG. 5 is a view showing a state in which the blade is held by the fall preventing member when the attachment part of the blade to the support portion is broken in the ceiling fan according to the first embodiment.

In addition, the blade 11 is separated from the support portion 10 outward in the radial direction so that the respective loop portions 35 and 36 of the fall preventing member 34 are deformed, and furthermore, the protruded portion 32 is separated by the opening groove 31 of the root portion 12 of the blade 11 (the opening groove 31 and the protruded portion 32 are disengaged from each other). The blade 11 is further separated by the centrifugal force and the inner edge 12*a* of the root portion 12 of the blade 11 is positioned on an outside in the radial direction from the outer edge 25*a* of the support portion 10 (see FIG. 5). On the other hand, the centrifugal force of the blade 11 or the like is applied to the fall preventing member 34 to cause large deformation. However, the fall preventing member 34 penetrates the through hole 33 in the first loop portion 35 and the second loop portion 36 is engaged with the protruded portion 32. Consequently, the blade 11 is held in the support portion 10 through the loop portions 35 and 36 of the fall preventing member 34 so that the fall of the blade 11 can be prevented.

Figure 6:
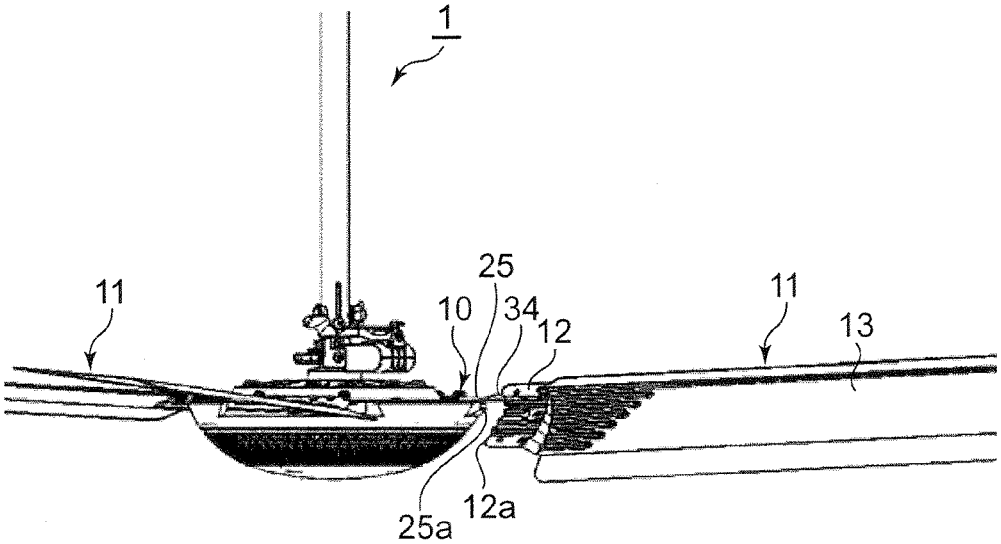
FIG. 6 is a side view showing the state in which the blade is held by the fall preventing member when the attachment part of the blade to the support portion is broken in the ceiling fan according to the first embodiment (at an operation time).

When the operation of the ceiling fan 1 is continuously carried out in this state, the blade 11 in the holding state on the support portion 10 through the fall preventing member 34 tries to hold a posture in a horizontal state by the centrifugal force generated by the rotation as shown in FIG. 6. However, the inner edge 12*a* of the root portion 12 of the blade 11 is positioned on the outside of the outer edge 25*a* of the support portion 10. For this reason, the rotating posture of the blade 11 is brought into an unstable state. For example, a forward side end in the rotating direction of the blade 11 is inclined to be lowered greatly from a rear side end so that high resistance is applied to the vane portion 13 of the rotated blade 11 and the behavior of the blade 11 is brought into an unstable state. Therefore, even if the operation of the ceiling fan 1 is continuously carried out, a user can clearly recognize the unstable behavior of the blade 11 and can grasp that breakage or the like is caused on the blade 11.

Moreover, the through hole 33 through which the wire rod of the fall preventing member 34 penetrates is provided in the position shifted from the center in the width direction of the root portion 12 of the blade 11. Consequently, it is possible to reliably cause an inclination posture to be taken in the blade 11 held by the fall preventing member 34.

Figure 7:
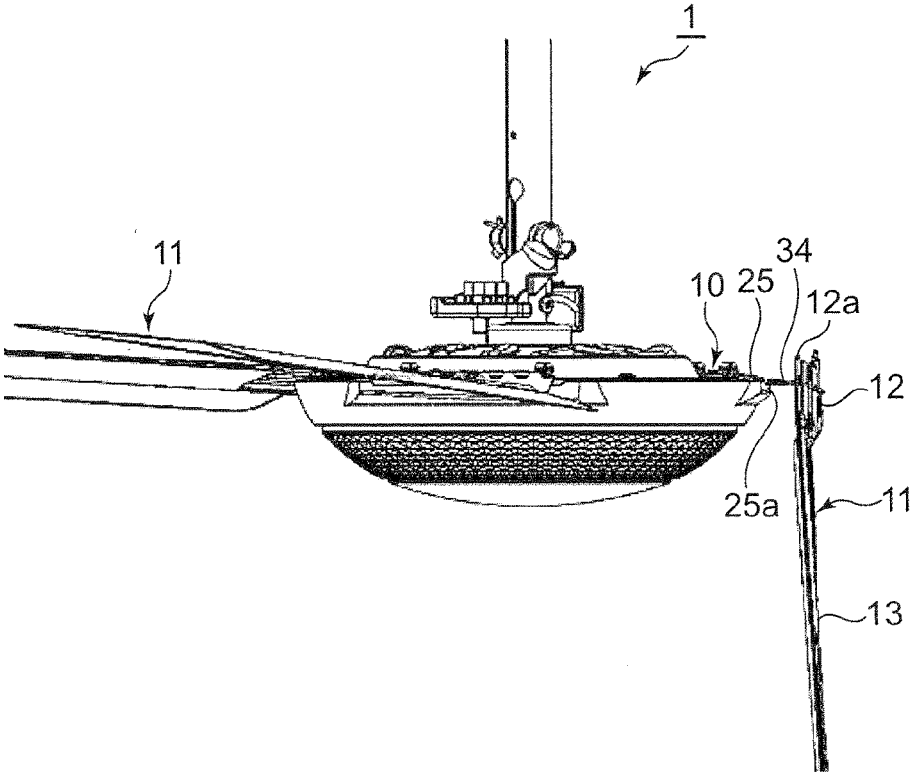
FIG. 7 is a side view showing the state in which the blade is held by the fall preventing member when the attachment part of the blade to the support portion is broken in the ceiling fan according to the first embodiment (at a stop time).

In a state in which the operation of the ceiling fan 1 is stopped, moreover, the inner edge 12*a* of the root portion 12 of the blade 11 is positioned on the outside of the outer edge 25*a* of the support portion 10 as shown in FIG. 7. Consequently, the edge on the outside in the radial direction of the blade 11 is suspended greatly so that an almost vertical posture can be taken. In the state in which the operation of the ceiling fan 1 is stopped, therefore, a user can clearly recognize the almost vertical posture of the blade 11 and can grasps that the breakage or the like is caused on the blade 11.

Furthermore, the through hole 33 is caused to take a shape of a slot extended in a length direction of the blade 11. Consequently, it is possible to hold the blade 11 by the fall preventing member 34 by ensuring such a separation distance (stroke) as to enable the inner edge 12*a* of the blade 11 to be positioned on the outside of the outer edge 25*a* of the support portion 10.

In a state in which the fall preventing member 34 is attached to the blade 11, furthermore, the second loop portion 36 is disposed around the second hole 31*b* of the opening groove 31. Consequently, when the blade 11 is to be attached to the support portion 10, it is possible to bring a state in which the second loop portion 36 is disposed around the protruded portion 32 by simply inserting the protruded portion 32 of the receiving portion 25 into the second hole 31*b* of the opening groove 31 of the blade 11. By carrying out normal works for attaching the blade 11, therefore, it is possible to bring a state in which the fall preventing member 34 can be engaged with the engaging portion (the protruded portion 32) of the support portion 10. Thus, workability can be enhanced, and furthermore, it is possible to prevent engagement from being forgotten.

The opening groove 31 to be engaged with the protruded portion 32 is caused to take an opening shape in the inner edge 12*a* of the root portion 12 of the blade 11. In the case in which the breakage or the like is caused on the blade 11, consequently, the opening groove 31 is slid along the protruded portion 32 and the protruded portion 32 and the opening groove 31 are then disengaged from each other. Thus, the inner edge 12*a* of the blade 11 can be positioned on the outer side than the outer edge 25*a* of the support portion 10.

Moreover, the fall preventing member 34 includes the loop portions 35 and 36 formed by the wire rods and has such a clip function as to be fixed with the surface and the back face of the blade 11 interposed by the elastic deformation of the wire rods. Consequently, it is possible to attach the fall preventing member 34 to the blade 11 without using another member. For example, the fall preventing member 34 is attached in a proper position for the blade 11 at the time of factory shipment. When the ceiling fan 1 is to be assembled, consequently, it is possible to carry out an assembling work without paying attention to the fall preventing member 34. Accordingly, it is possible to prevent the attachment of the fall preventing member 34 from being forgotten.

Second Embodiment

Next, a ceiling fan according to a second embodiment of the present invention will be described. Referring to the ceiling fan according to the second embodiment, a configuration of a fall preventing member formed by a wire rod is different from that of the fall preventing member 34 according to the first embodiment. A difference between the configurations of the fall preventing members will be mainly described. In the ceiling fan according to the second embodiment, the same components as those of the ceiling fan 1 according to the first embodiment have the same reference numerals and description thereof will be omitted.

Figure 8:
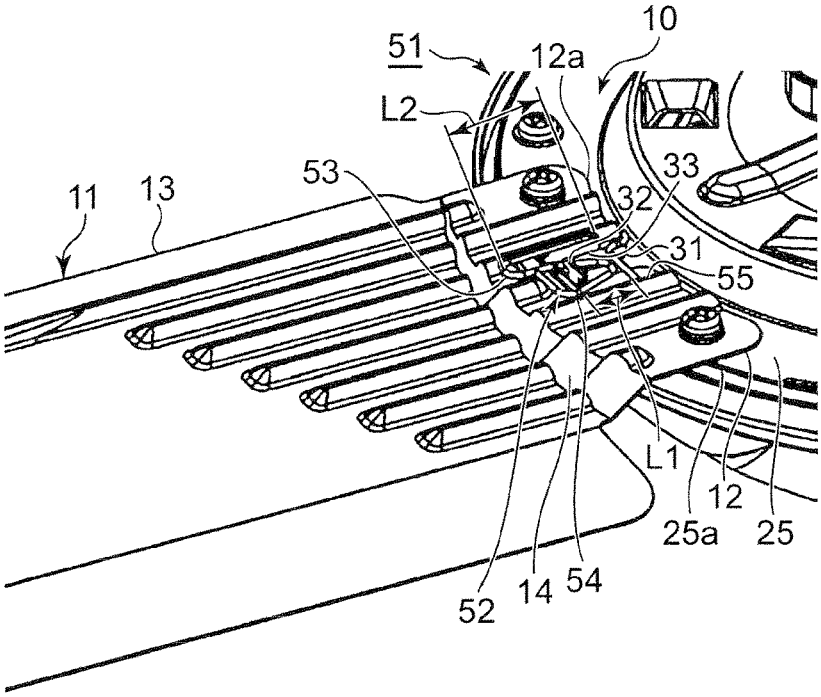
FIG. 8 is a partial enlarged view showing an attachment part of a blade to a support portion in a ceiling fan according to a second embodiment of the present invention.

FIG. 8 is a partial enlarged view showing an attachment part of a blade 11 to a support portion 10 in a ceiling fan 51 according to the second embodiment. Moreover, FIG. 9 is a view showing an external appearance of a fall preventing member 52.

Figure 9:
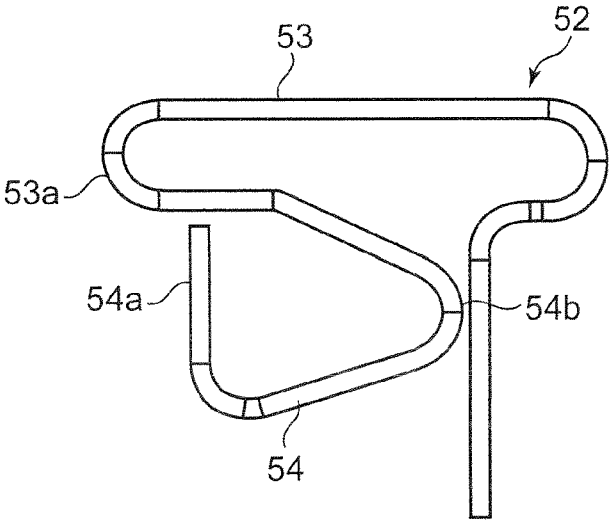
FIG. 9 is a view showing an external appearance of a fall preventing member provided in the ceiling fan according to the second embodiment.

As shown in FIGS. 8 and 9, a diameter of a wire rod for forming the fall preventing member 52 is increased so that a loop portion is deformed with difficulty in the ceiling fan 51 according to the second embodiment. The fall preventing member 52 is formed by bending a single wire rod so as to have a first loop portion 53 and a second loop portion 54. The first and second loop portions 53 and 54 are formed into a single loop.

The first loop portion 53 takes a shape of a long loop in a length direction of the blade 11 and a bent portion (curved portion) 53*a* obtained by curving a wire rod is provided on an end at a radial outside of the blade 11 in a longitudinal direction thereof.

The second loop portion 54 takes a shape of an almost triangular loop and a base portion 54*a* of the almost triangular shape is disposed in a width direction of the blade 11, and furthermore, a top portion 54*b* opposed to the base portion is provided toward an inner edge 12*a* side of a root portion 12 of the blade 11. In the second loop portion 54, an opening width in the width direction of the blade 11 (a width of a loop portion surrounded by a wire rod) is gradually reduced closer to the top portion 54*b*. Moreover, the top portion 54*b* of the second loop portion 54 serves as a bent portion (curved portion) 54*b* obtained by curving a wire rod.

A notch portion 55 is provided on the inner edge 12*a* of the root portion 12 of the blade 11, and one of ends of the wire rod of the fall preventing member 52 is inserted in and engaged with the notch portion 55. In the root portion 12 of the blade 11, a through hole 33 and the notch portion 55 are disposed with an opening groove 31 interposed therebetween. For this reason, in a state in which the fall preventing member 52 is attached to the blade 11, a back face side (a lower face side) of the blade 11 and a wire rod are engaged in contact with each other in the through hole 33 and the notch portion 55. In addition, the wire rod of the second loop portion 54 is provided in contact with a front face side (an upper face side) of the blade 11 around a second hole 31*b* of the opening groove 31 positioned between the through hole 33 and the notch portion 55. Consequently, it is possible to stably attach the fall preventing member 52 to the blade 11 by interposing the front and back faces of the blade 11 (that is, by utilizing a clip function) while elastically deforming the wire rod of the fall preventing member 52.

In a state in which the fall preventing member 52 of the blade 11 is attached as shown in FIG. 8, the wire rod of the first loop portion 53 penetrates the through hole 33 and the wire rod penetrates an opening part at a radial outside of a slot shape. Moreover, the second loop portion 54 is disposed around a protruded portion 32 and the second hole 31*b* of the opening groove 31. Moreover, the protruded portion 32 is positioned in the vicinity of the base portion 54*a* of the almost triangular shape and a distance L1 is maintained between the top portion 54*b* and the protruded portion 32 at an inside of the second loop portion 54. Moreover, a distance L2 is maintained as an opening length in a longitudinal direction of the through hole 33 through which the first loop portion 53 penetrates.

Description will be given to a function and operation for preventing fall of the blade 11 by the fall preventing member 52 in the case in which the attachment part of the blade 11 to the support portion 10 is broken, for example, the root portion 12 of the blade 11 is broken in the ceiling fan 51 according to the second embodiment.

In the case in which breakage or the like is caused on the attachment part of the blade 11 and the support portion 10 during the operation of the ceiling fan 51, the root portion 12 of the blade 11 tries to be separated by centrifugal force in an outer direction (outward in a radial direction) from the receiving portion 25 of the support portion 10. When the blade 11 starts movement outward in the radial direction, the opening groove 31 engaged with the protruded portion 32 is slid with respect to the protruded portion 32 of the receiving portion 25. On the other hand, the distance L1 is maintained between the top portion 54*b* and the protruded portion 32 at the inside of the second loop portion 54. For this reason, the second loop portion 54 of the fall preventing member 52 will come in contact with the protruded portion 32 so that both of them are engaged with each other only after the opening groove 31 is slid by the distance L1 with respect to the protruded portion 32. At this time, the second loop portion 54 takes an almost triangular shape and has a reduced opening width as gradually closer to the top portion 54*b*. Therefore, the protruded portion 32 and the top portion 54*b* of the second loop portion 54 are easily engaged with each other.

Figure 10:
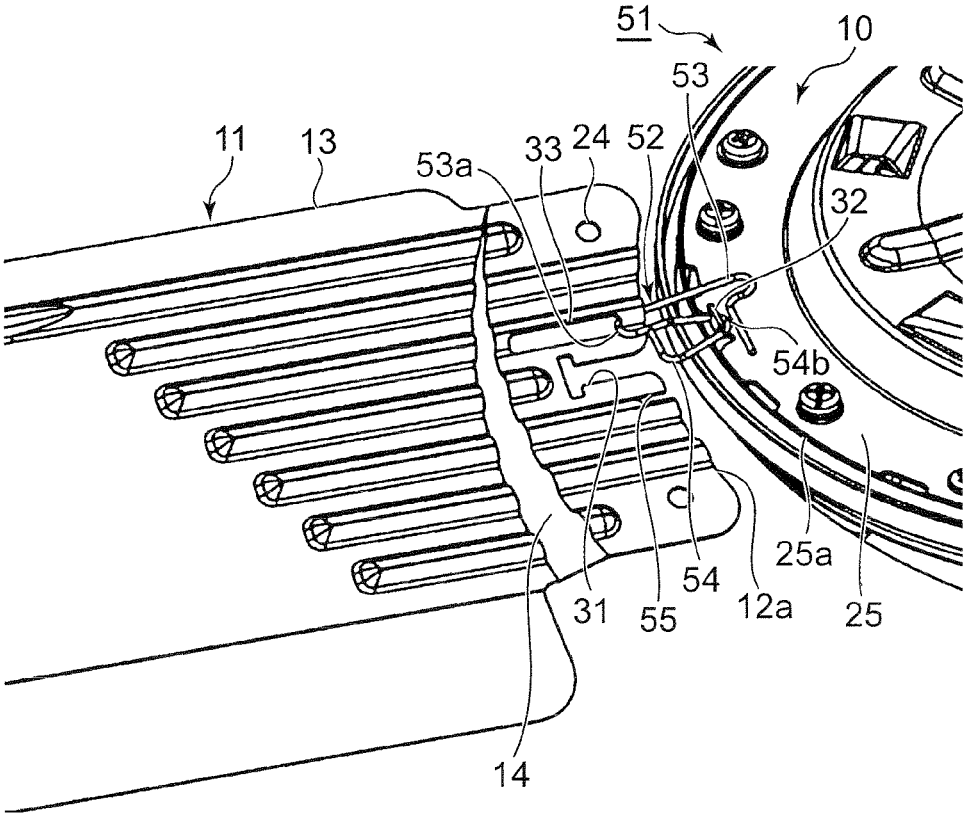
FIG. 10 is a view showing a state in which the blade is held by the fall preventing member when the attachment part of the blade to the support portion is broken in the ceiling fan according to the second embodiment.

Furthermore, the blade 11 is separated from the support portion 10 outward in the radial direction. Consequently, a bent portion 53*a* of the first loop portion 53 of the fall preventing member 52 is slid relatively in the longitudinal direction of the through hole 33 taking a shape of a slot. When the sliding movement is carried out by the distance L2, the bent portion 53*a* of the first loop portion 53 comes in contact with the end on the inside in the radial direction of the blade 11 in the through hole 33. In this state, the inner edge 12*a* of the root portion 12 of the blade 11 is positioned on an outside in the radial direction from the outer edge 25*a* of the support portion 10 (see FIG. 10). In this state, the first loop portion 53 penetrates the through hole 33 and the second loop portion 54 is engaged with the protruded portion 32. Consequently, the blade 11 is held in the support portion 10 through the loop portions 53 and 54 of the fall preventing member 52 so that the fall of the blade 11 can be prevented.

In the fall preventing member 52 according to the second embodiment, a diameter of the wire rod is increased so that the loop portion is deformed with difficulty. However, the distance L1 is maintained between the top portion 54*b* of the second loop portion 54 and the protruded portion 32, and the distance L2 is maintained as the opening length in the longitudinal direction of the through hole 33 through which the first loop portion 53 penetrates. A total distance of the distance L1 and the distance L2 serves as a stroke in which the blade 11 is moved to the outside in the radial direction. Thus, the stroke (that is, L1+L2) is set. Even if the wire rod of the fall preventing member 52 is not deformed, consequently, the inner edge 12*a* of the root portion 12 of the blade 11 can be positioned on the outside of the outer edge 25*a* of the support portion 10.

In the fall preventing member 52, a bent portion 53*a* is provided on the first loop portion 53 and the inner edge 12*a* of the through hole 33 is caused to come in contact with the wire rod in the bent portion 53*a*. Consequently, it is possible to suppress stress concentration on the wire rod. Moreover, the top portion 54*b* of the second loop portion 54 serves as the bent portion to come in contact with the protruded portion 32. Consequently, it is possible to suppress the stress concentration on the wire rod.

The ceiling fan 51 according to the second embodiment is the same as the ceiling fan 1 according to the first embodiment in that a user can clearly recognize a breakage of the blade in the event of the breakage at an operation time and a stop time. By using the fall preventing member 52 according to the second embodiment, it is possible to reliably hold the blade 11 with use of the fall preventing member 52 having higher rigidity in the event of the breakage of the blade 11.

Third Embodiment

Next, a ceiling fan according to a third embodiment of the present invention will be described. Referring to the ceiling fan according to the third embodiment, a configuration of a fall preventing member formed by a wire rod is different from that of the fall preventing members 34, 52 according to the first and second embodiments. A difference between the configurations of the fall preventing members will be mainly described. In the ceiling fan according to the third embodiment, the same components as those of the ceiling fans 1, 51 according to the first and second embodiments have the same reference numerals and description thereof will be omitted.

Figure 11:
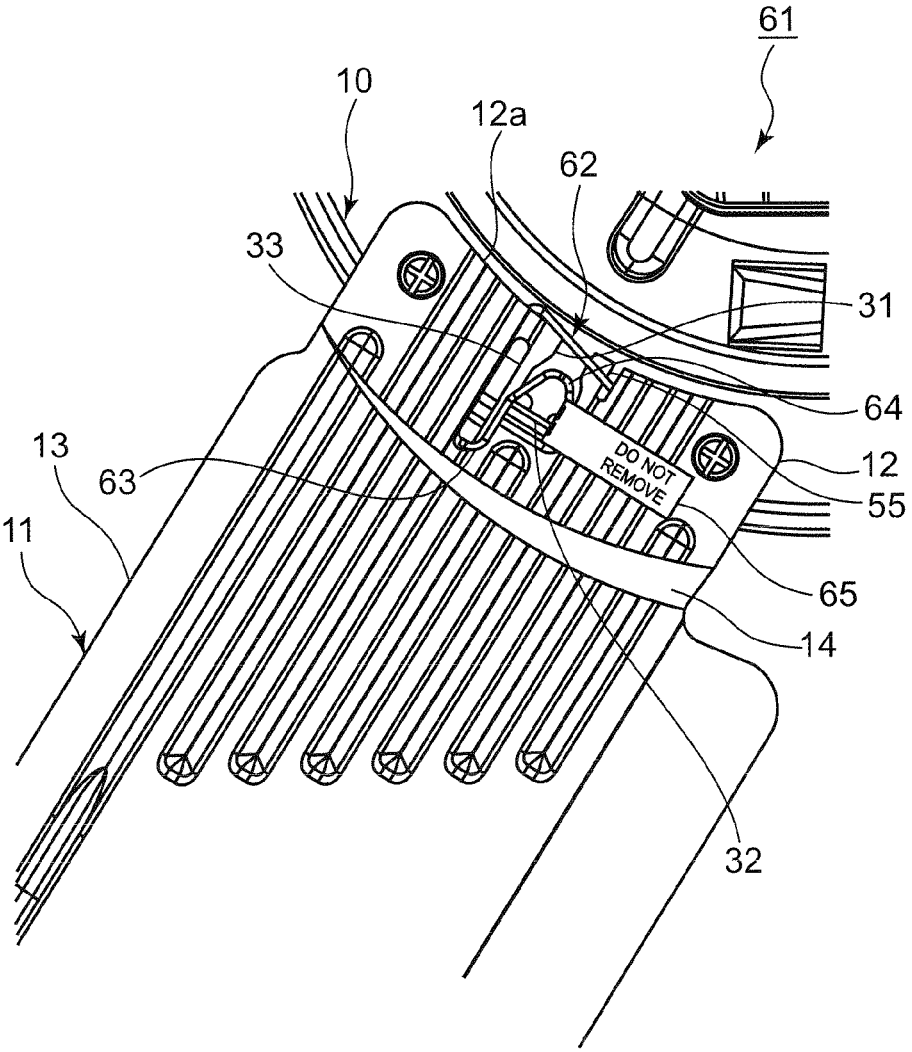
FIG. 11 is a partial enlarged view showing an attachment part of a blade to a support portion in a ceiling fan according to a third embodiment of the present invention.

FIG. 11 is a partial enlarged view showing an attachment part of a blade 11 to the support portion 10 in a ceiling fan 61 according to the third embodiment. Moreover, FIG. 12 is a view showing an external appearance of a fall preventing member 62 in an attached state to the blade 11, and FIG. 13 is a view showing an external appearance of the fall preventing member 62.

Figure 12:
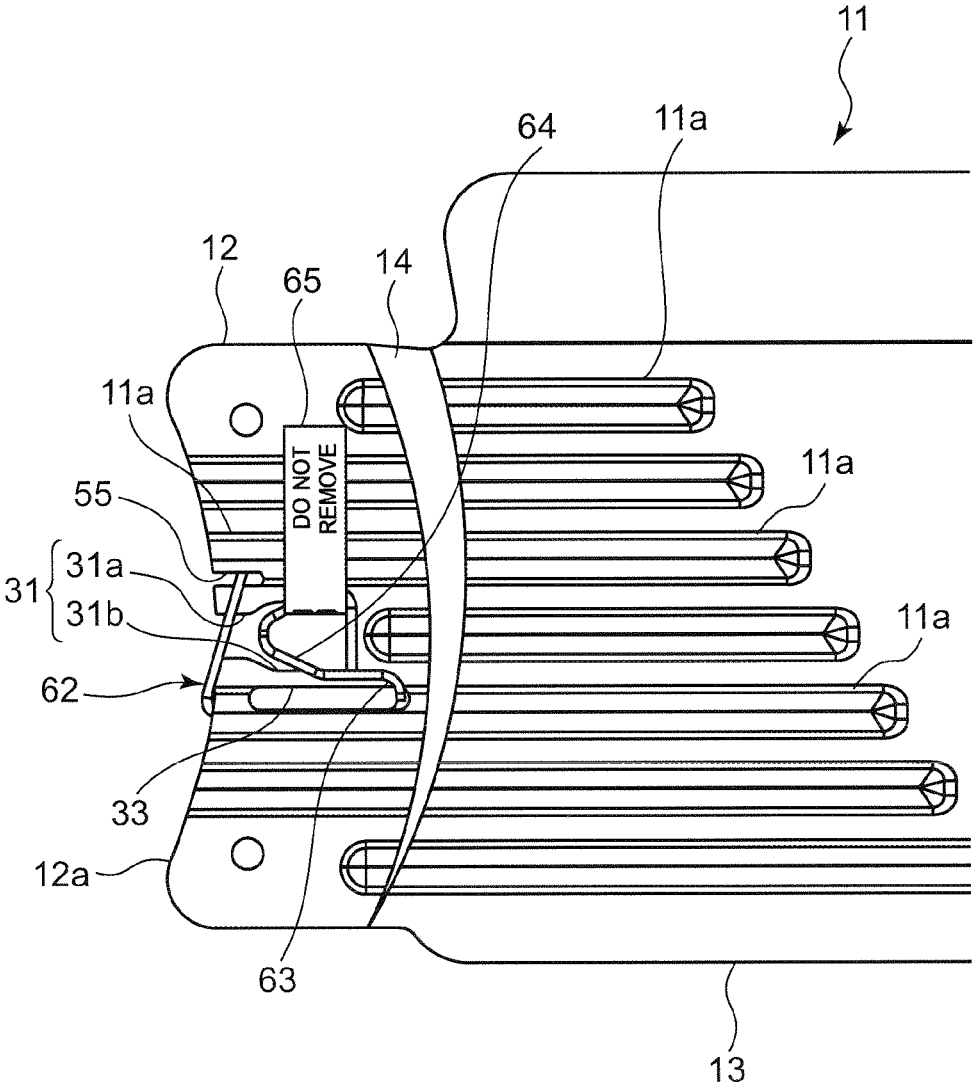
FIG. 12 is a view showing an external appearance of a fall preventing member provided in the ceiling fan according to the third embodiment in an attached state to the blade.
Figure 13:
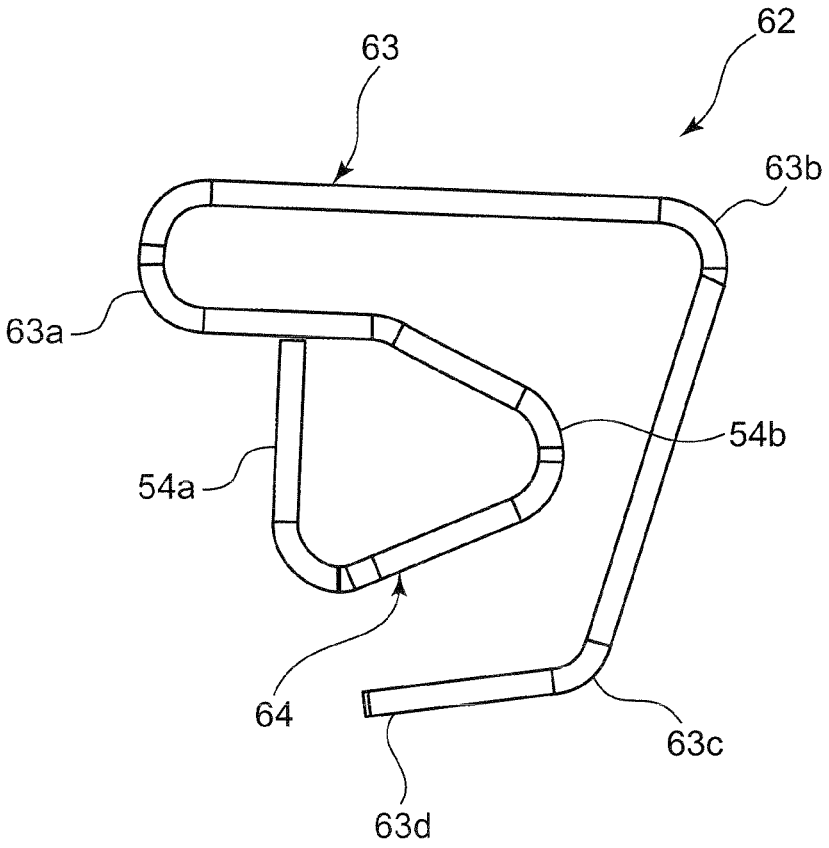
FIG. 13 is a view showing an external appearance of a fall preventing member of the ceiling fan according to the third embodiment.

As shown in FIGS. 11 through 13, a diameter of a wire rod for forming the fall preventing member 62 is increased so that a loop portion is deformed with difficulty in the ceiling fan 61 according to the third embodiment in the same manner as the fall preventing member 52 of the second embodiment. The fall preventing member 62 is formed by bending a single wire rod so as to have a first loop portion 63 and a second loop portion 64. The first and second loop portions 63 and 64 are formed into a single loop. The second loop portion 64 has the same configuration as the second loop portion 54 of the fall preventing member 52 of the second embodiment.

As shown in FIG. 13, the first loop portion 63 takes a shape of a long loop in a length direction of the blade 11 and a bent portion (curved portion) 63*a* obtained by curving a wire rod is provided on an end at a radial outside of the blade 11 in a longitudinal direction thereof. A bent portion 63*b* is provided on an inside end in the radial direction of the blade 11 in the loop shape of the first loop portion 63. The bent portion 63*b* is obtained by curving the wire rod toward a direction approximately intersecting with the radial direction (for example, the wide direction of the blade). Further, the wire rod is extending from the bent portion 63*b* to a position across the second loop portion 64 in the wide direction of the blade 11, and at the position, a bent portion 63*c* obtained by curving the wire rod toward the outside end in the radial direction of the blade 11. The end of the wire rod toward the outside end in the radial direction of the blade 11 from the bent portion 63*c* is an engaging portion 63*d* engaging the wire rod with the blade 11.

The engaging portion 63*d* which is one of ends of the wire rod of the fall preventing member 62 is inserted in and engaged with the notch portion 55 provided on the inner edge 12*a* of the root portion 12 of the blade 11. The engaging portion 63*d* is inserted in the notch portion 55 by inserting while elastically deforming the engaging portion 63*d* which is a linear part of the wire rod so as to bring the engaging portion 63*d* close to the second loop portion 64 in the wide direction of the blade 11.

The blade 11 is provided with a plurality of groove 11*a* (convex portions in the upper view and concave portions in the lower view) extending in the length direction of the blade 11 on a back face of the blade 11. The notch portion 55 is formed along the groove 11*a* extended in the longitudinal direction of the blade 11. Therefore, the engaging portion 63*d* is inserted in the notch portion 55 from the front face side to the back face side of the blade 11 so that the engaging portion 63*d* is disposed in the groove 11*a* and engaged with an inner surface of the groove 11*a*.

The through hole 33 having the slot shape is formed along another groove 11*a* extended in the longitudinal direction of the blade 11. Therefore, the liner part of the wire rod (between the bent portions 63*a* and 63*b*) inserted in the through hole 33 is disposed in the groove 11*a* and engaged with an inner surface of the groove 11*a*.

The engaging portion engaging with the blade 11 in the fall preventing member 62 is disposed in and along the groove 11*a* formed in the blade 11 thereby enhancing the clip function by utilizing the elasticity of the blade 11. In addition, it is possible to suppress positional shift of the fall preventing member 62 in the wide direction of the blade 11 thereby enhancing a positional accuracy of the fall preventing member 62.

As shown in FIGS. 11 and 12, a seal tape 65 is attached on the front face of the blade 11 so as to extend in the wide direction of the blade 11. One end of the seal tape 65 is attached to the wire rod of the second loop portion 64 of the fall preventing member 62. Thereby, it is possible to prevent positional shift of the fall preventing member 62 in the longitudinal direction of the blade 11. The seal tape 65 is attached along the front face having a plurality of convex and concave portions of the grooves 11*a*, thereby it is possible to prevent peeling off the seal tape 65. On the other hand, an external force is applied to the fall preventing member 62 so as to move the fall preventing member 62 in the longitudinal direction of the blade 11, this movement of the fall preventing member leads to break the seal tape 65. Accordingly, it is possible to make a judgment on whether the fall preventing member 62 is attached in the proper position by confirming whether the seal tape 65 does not have a break.

Figure 14:
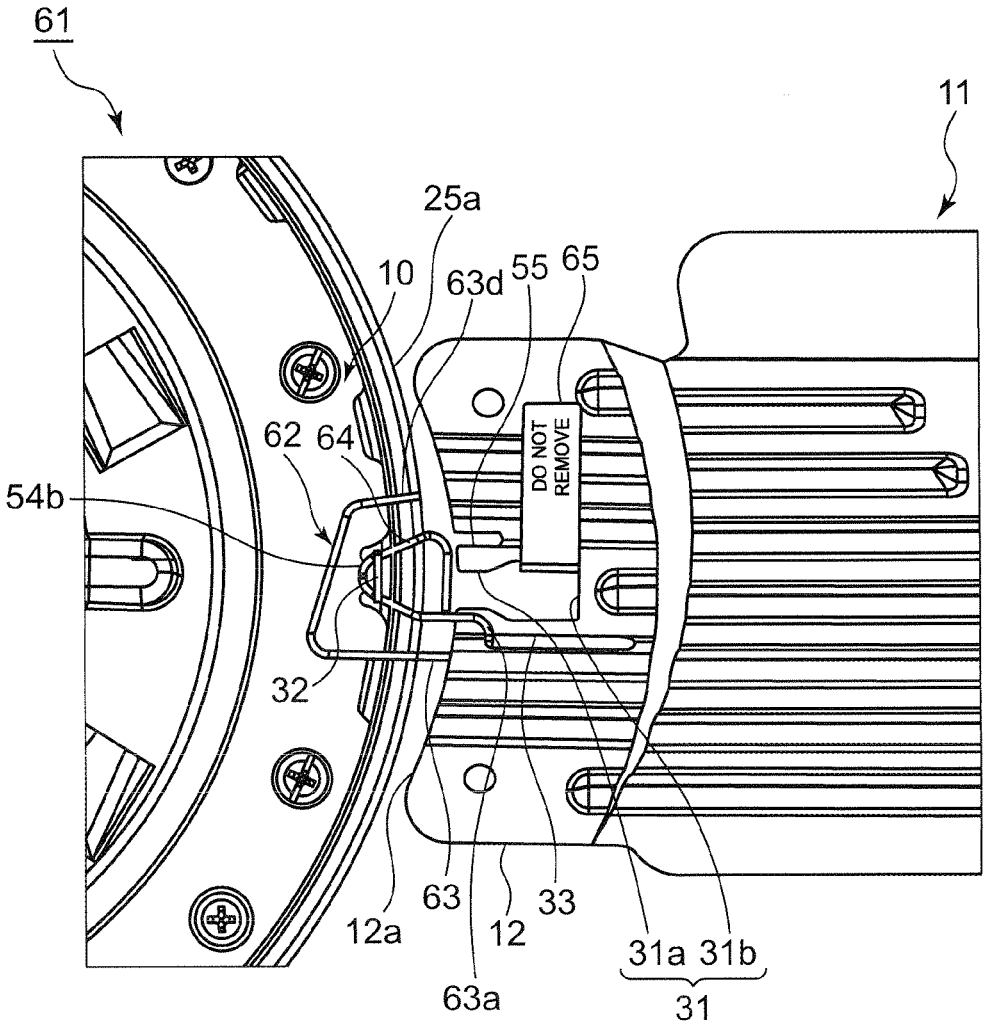
FIG. 14 is a view showing a state in which the blade is held by the fall preventing member when the attachment part of the blade to the support portion is broken in the ceiling fan according to the third embodiment.
Figure 15:
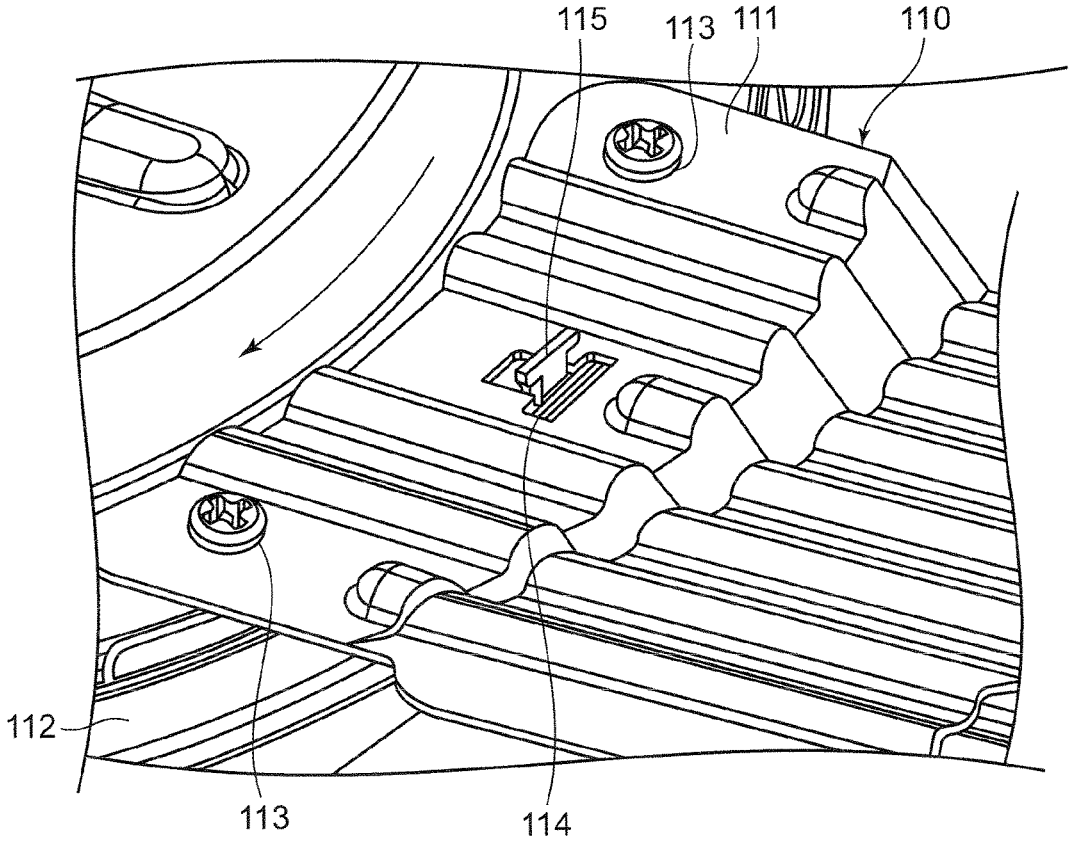
FIG. 15 is a view showing a structure of a blade fall preventing portion provided in a conventional ceiling fan.

The ceiling fan 61 according to the third embodiment is the same as the ceiling fan 51 according to the second embodiment in that the ceiling fan 61 has a function and operation for preventing fall of the blade 11 by the fall preventing member 62 in the case in which the attachment part of the blade 11 to the support portion 10 is broken, for example, the root portion 12 of the blade 11 is broken in the ceiling fan 61 (refer to FIG. 14). Accordingly, a user can clearly recognize a breakage of the blade in the event of the breakage at an operation time and a stop time. By using the fall preventing member 62 according to the third embodiment, it is possible to attach the fall preventing member 62 to the blade 11 with enhancing a positional accuracy thereof. Furthermore, it is possible to enhance a clip function of the fall preventing member 62 thereby making it easy to attach the fall preventing member 62 to the blade 11.

In the description of the embodiments, there is taken, as an example, the case in which the second loop portion 36 of the fall preventing member 34 is engaged with the protruded portion 32 protruded in the vicinity of the outer edge 25*a* of the receiving portion 25 in the support portion 10. However, the configuration of the protruded portion 32 is not restricted to only this case. In the support portion 10, it is preferable to provide an engaging portion with which the second loop portion 36 can be engaged. It is possible to employ various structures other than the protruded portion 32 as the configuration of the engaging portion.

Moreover, as an example, the case was described in which the through hole 33 through which the wire rod of the fall preventing member 34 penetrates is disposed with a shift (that is, eccentricity) from the center in the width direction of the blade 11 in the root portion 12 of the blade 11. However, the formation position of the through hole is not restricted to only this configuration. For example, it is possible to employ the case in which the through hole is disposed on the center in the width direction of the blade 11. In this case, when the blade 11 is broken, it is possible to bring the behavior of the blade 11 into an unstable state to some degree by positioning the inner edge 12*a* of the root portion 12 of the blade 11 at the outside of the outer edge 25*a* of the support portion 10.

Although as an example, the case was described in which the fall preventing member has two loop portions, that is, the first loop portion and the second loop portion, furthermore, it is possible to employ the case in which only one loop portion is provided.

By properly combining optional ones of the various embodiments, it is possible to produce the respective advantages.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

EXPLANATION OF REFERENCE NUMERALS

1 ceiling fan
2 suspending portion
3 body portion
4 coupling portion
5 joint
6 pipe
7 rotary driving portion
8 stator
9 rotor
10 support portion
11 blade
12 root portion
12*a* inner edge
13 vane portion
14 step portion
22 body cover
23 fixing portion
24 fastening hole
25 receiving portion
25*a* outer edge (outer peripheral edge)
26 hole (hole of receiving portion 25)
31 opening groove
31*a* first hole
31*b* second hole
32 protruded portion
32*a* first flat plate portion
32*b* second flat plate portion
33 through hole
34 fall preventing member
35 first loop portion
36 second loop portion
38 notch portion
50 ceiling
51 ceiling fan
52 fall preventing member
53 first loop portion
53*a* bent portion
54 second loop portion
54*a* base portion
54*b* top portion (bent portion)
55 notch portion
61 ceiling fan
62 fall preventing member

What is claimed is:

1. A ceiling fan comprising:

a coupling portion having an upper part supported on a ceiling;

a rotary driving portion having a stator fixed to a lower part of the coupling portion and a rotor to be rotary driven around the stator;

a plurality of blades to be rotated around a center of the rotor by the rotary driving portion;

a support portion which is fixed to the rotor and to which root portions of the blades are attached in a mounting state; and a fall preventing member having a loop portion formed by a wire rod so as to be engageable with the blades and the support portion, wherein a through hole is provided in the root portions of the blades, the loop portion of the fall preventing member penetrating the through hole, the support portion is provided with an engaging portion, the support portion being engageable with the loop portion of the fall preventing member, and the loop portion of the fall preventing member is disposed to be engageable with the engaging portion of the support portion in a state that the blades are attached to the support portion, the loop portion is engaged with the engaging portion of the support portion when an attachment part of the support portion and the blades is broken, and the blades are held on the support portion through the loop portion of the fall preventing member in a state that inner edges of the root portions of the blades are positioned on an outside of an outer edge of the support portion.

2. The ceiling fan according to claim 1, wherein a protruded portion is formed as the engaging portion on the support portion, and the root portion of the blade is provided with an opening groove which is extended in a length direction of the blade and is opened at the inner edge of the root portion, and is slidably engaged with the protruded portion, and in a state that the blade is attached to the support portion, the protruded portion of the support portion is engaged with the opening groove of the root portion of the blade, and the loop portion of the fall preventing member is disposed around the protruded portion.

3. The ceiling fan according to claim 1, wherein the blade is attached to the support portion by a fastening member through a fastening hole provided on the root portion of the blade, and the fastening hole is provided separately from a through hole through which the loop portion of the fall preventing member penetrates.

4. The ceiling fan according to claim 1, wherein the through hole of the root portion of the blade is disposed in a shifted position from a center in a width direction of the blade.

5. The ceiling fan according to claim 1, wherein the through hole of the root portion of the blade is a slot extended in a length direction of the blade, and the loop portion of the fall preventing member penetrates an opening portion at an outside in the length direction of the blade in the slot in a state that the blade is attached to the support portion.

6. The ceiling fan according to claim 1, wherein the loop portion of the fall preventing member includes a discontinuous part of a wire rod and the fall preventing member has a clip function for fixing the loop portion to the blade releasably with front and back faces of the blade interposed by elastic deformation of the loop portion in a thickness direction of the blade.

7. The ceiling fan according to claim 6, wherein the inner edge of the root portion of the blade is provided with a notch portion where one of ends of the wire rod of the fall preventing member is inserted and engaged.

8. The ceiling fan according to claim 7, wherein the blade is provided with a plurality of groove extending in the length direction of the blade on a back face of the blade, and the one of ends of the wire rod of the fall preventing member which is inserted in the notch portion of the inner edge of the root portion of the blade is disposed in the groove of the blade and engaged with the groove of the blade.

9. The ceiling fan according to claim 1, wherein the fall preventing member includes a first loop portion penetrating the through hole of the root portion of the blade and a second loop portion which is engageable with the engaging portion of the support portion, and the first loop portion and the second loop portion are formed continuously by a single wire rod.

* * * * *